US005221242A

United States Patent [19]

Weber et al.

[11] Patent Number: 5,221,242

[45] Date of Patent: Jun. 22, 1993

[54] LEG EXERCISE DEVICE

[76] Inventors: James C. Weber, 47 W. Lake Dr., Antioch, Calif. 94509; Clayton L. Nannen, 110 Acorn La., #208, Pittsburg, Calif. 94565; Michael Pollard, 33601 Pacific Way, Fort Bragg, Calif. 95437; Donald R. Pollard, P.O. Box 106, Mendocino, Calif. 95460

[21] Appl. No.: 725,026

[22] Filed: Jul. 3, 1991

[51] Int. Cl.[5] ..... A63B 23/08; A63B 22/14

[52] U.S. Cl. ..... 482/79; 482/113; 482/142; 482/145; 482/147

[58] Field of Search ..... 482/79, 111, 112, 113, 482/142, 145, 146, 147; 128/25 B

[56] References Cited

U.S. PATENT DOCUMENTS 3,702,188 11/1972 Phillips et al. ..... 482/113
4,199,137 4/1980 Guguére .
4,650,183 3/1987 McIntyre ..... 482/79
4,807,874 2/1989 Little .
4,998,720 3/1991 Kim ..... 482/79
5,054,771 10/1991 Mansfield ..... 482/112
5,094,226 3/1992 Medcalf et al. ..... 128/25 B

*Primary Examiner*—Richard J. Apley
*Assistant Examiner*—Lynne A. Reichard
*Attorney, Agent, or Firm*—Limbach & Limbach

[57] ABSTRACT

A device for exercising internal and external muscles of the leg is provided. The device includes a foot holder for pivotally supporting a user's foot. The foot holder is capable of pivoting around an axis which is substantially perpendicular to the foot, and near the front of the user's leg. The device also includes a tension control unit for providing constant resistance to pivoting of the foot holder. The device preferably has separate foot holders and hydraulic tension control units for each foot.

3 Claims, 3 Drawing Sheets

LEG EXERCISE DEVICE

FIELD OF THE INVENTION

The invention relates to exercise equipment. In particular, the invention involves a device for generally strengthening, toning or rehabilitating various leg muscles.

BACKGROUND OF THE INVENTION

People have become increasingly concerned with their health and fitness in recent years. The trend has included a growing sophistication in exercise alternatives in order to provide options for selectively strengthening or rehabilitating specific muscle groups. Although various machines have been developed for exercising a person's legs and ankles, devices for specifically exercising the internal and external rotator muscles have not appeared.

SUMMARY OF THE INVENTION

It is an object of the present invention to provide a device for exercising the internal and external rotator muscles of the leg.

Another object of the invention is to provide a device for exercising the peroneal muscles and the internal and external hip rotators.

The above objectives are accomplished with the leg exercise device of the present invention, which includes a foot holder for pivotally supporting a user's foot. The foot holder is capable of pivoting around an axis which is substantially perpendicular to the foot, and near the front of the user's leg.

The device also includes a tension means for imparting constant resistance to pivoting of the foot holder.

In one embodiment of the invention two foot holders are provided side by side, together with respective tensioning means, allowing the user to exercise both legs simultaneously. The foot holders may also be connected to a seat which is adjustable to vary the distance between the foot holders and seat. The seat height is also adjustable. The device may also include an upper leg post located between the foot holders and the seat for maintaining the positions of the upper legs while exercising.

Another embodiment of the present invention is designed to be portable and compact. The foot holders are pivotally mounted on the support surface. The support surface has collapsible support arms for maintaining a constant angle relative to the ground while exercising. When the device is not being used, the support arms can be folded up to produce a compact unit for easy storage or transport. An object, designed to be gripped by the user's knees, is preferably tethered to the device.

The device of the present invention is useful for both general muscle strengthening and toning as well as rehabilitating leg muscles after injuries.

DETAILED DESCRIPTION OF THE PREFERRED EMBODIMENTS

A first embodiment of the invention is designed for use in exercise rooms where there is no particular need for equipment portability. The first embodiment includes accessories which maximize its ease of use. A second embodiment of the invention is designed to be portable. While including the essential components of the invention, the second embodiment is made of light materials and is capable of folding into a compact form which can be easily transported or stored. A third embodiment of the invention is similar to the first embodiment except it employs a hydraulic breaking system and has additional adjustability features.

Figure 1:
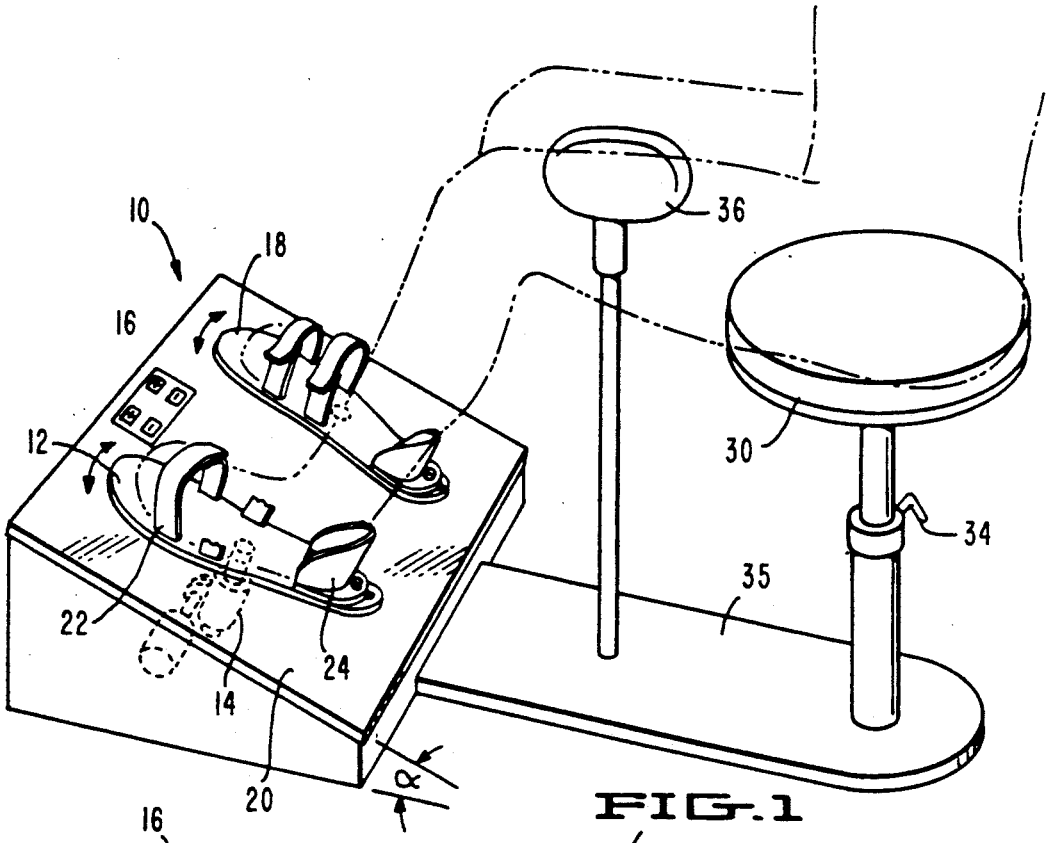
FIG. 1 is a perspective view of a first embodiment of the present invention.

In FIG. 1, the first embodiment of the present invention 10 includes a foot holder 12 for pivotally supporting the user's foot, so as to maintain a fixed angle $\alpha$ relative to the ground while in use (however, $\alpha$ can be adjustable if necessary or desireable). The foot holder 12 is connected to a tension means 14 for providing resistance to lateral rotation of the user's foot. The term "lateral rotation" is defined to mean rotation around an axis at the core of support rod 37 (FIG. 2), which is perpendicular to foot holder 12 and usually substantially parallel to the user's leg. The user may control the amount of resistance exerted by the tension means 14 by making adjustments on the control panel 16.

A second foot holder 18 is similar to foot holder 12 except that it is configured for the opposite foot. Foot holders 12 and 18 are pivotally mounted on a support board 20 which maintains a fixed angle $\alpha$ relative to the ground.

The foot holders include means for fastening the foot to the foot holder, such as the straps 22 shown in FIG. 1. The straps may be fastened by Velcro TM, or snaps etc., so long as they allow flexibility for accommodating different foot sizes.

Figure 2:
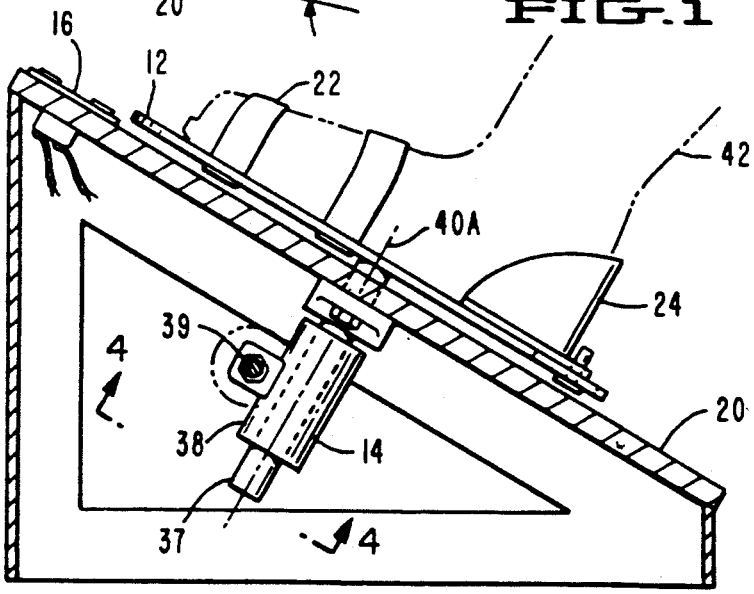
FIG. 2 is a partial side sectional view of the first embodiment of the present invention.

For proper exercise results, it is important that the pivot points of the foot holders be positioned near the front of the user's leg, as shown in FIG. 2. Therefore, it is preferable that the heel section 24 of the foot holder be adjustable, so that regardless of the user's foot length, the foot holder pivot point can be optimally positioned near the front of the user's leg.

As shown in FIG. 1, the first embodiment also includes a seat 30 for the user to sit on while exercising. The seat is preferably adjustable in two directions. First, the seat height is adjustable by manipulating a knob 34 below the seat 30. Second, the distance between the seat 30 and the foot holder support board 20 is also adjustable. By varying the distance between the foot holders 12, 18 and the seat 30, the degree by which the user's legs are bent is variable. By varying the user's degree of leg bending, different leg muscles can be exercised.

For example, when the user's knees are almost fully extended, hip internal and external rotator muscles, including the three gluteal muscles and the piriformis, are exercised. Whereas, when the user's legs are substantially bent, as shown in FIG. 1, the primary muscles which are exercised are the internal and external leg rotators. These muscles include the biceps femoris (external rotator) and the semitendinosus and semimembranosus (internal rotators) as well as the gracilis and the sartorius. It is believed that the ankle evertors (peroneal muscles) are also exercised in a supplementary fashion.

Between the seat 30 and the foot holder support board 20 an upper leg post 36 is located. The seat 30 and the upper leg post 36 are both mounted on a base 35 which is connected to the foot holder support board 20. As shown in FIG. 1, the seat should be adjusted so that when the user's feet are secured in the foot holders, and the user is sitting on the seat, the bent legs straddle and grip the upper leg post 36.

FIG. 2 shows a partial side sectional view of the first embodiment. FIG. 2 illustrates more details of the tension means 14. A rod 37 is perpendicularly connected to the foot holder 12. Surrounding the rod 37 is a casing 38 which can be tightened around the rod 37 to a greater or lesser degree, depending on the desired tension level. The tension adjustment is performed by turning a bolt 39 which adjusts the circumference of the casing 38. The foot holder 12 is capable of rotating around the axis 40A which passes through the core of the rod 37. The axis 40A is substantially perpendicular to the user's foot, and is near the front of the user's leg 42.

Figure 3:
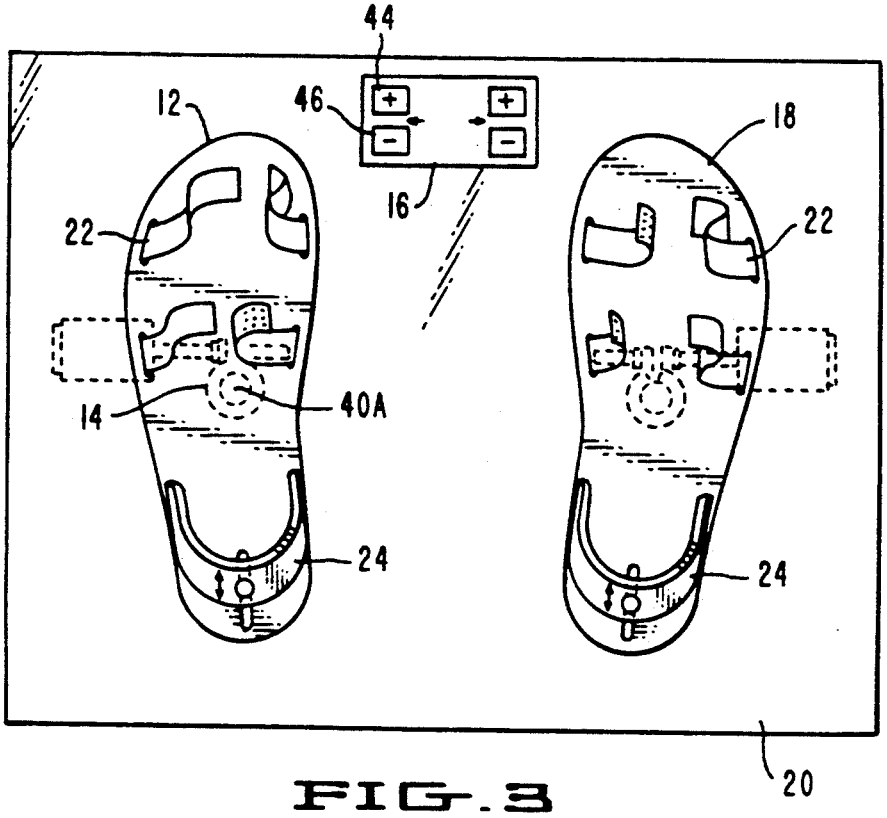
FIG. 3 is a top view of a portion of the first embodiment of the present invention.

FIG. 3 shows a top view of the first embodiment of the present invention. Foot holders 12 and 18 are configured to receive the user's left and right feet respectively. The control panel 16 provides easy push-button adjustment of the resistance which is applied to the respective foot holders via "+" and "−" button switches 44 and 46. These switches may be used to rotate bolt 39 to adjust the tension via an electric motor 33, as shown in FIG. 4.

Figure 4:
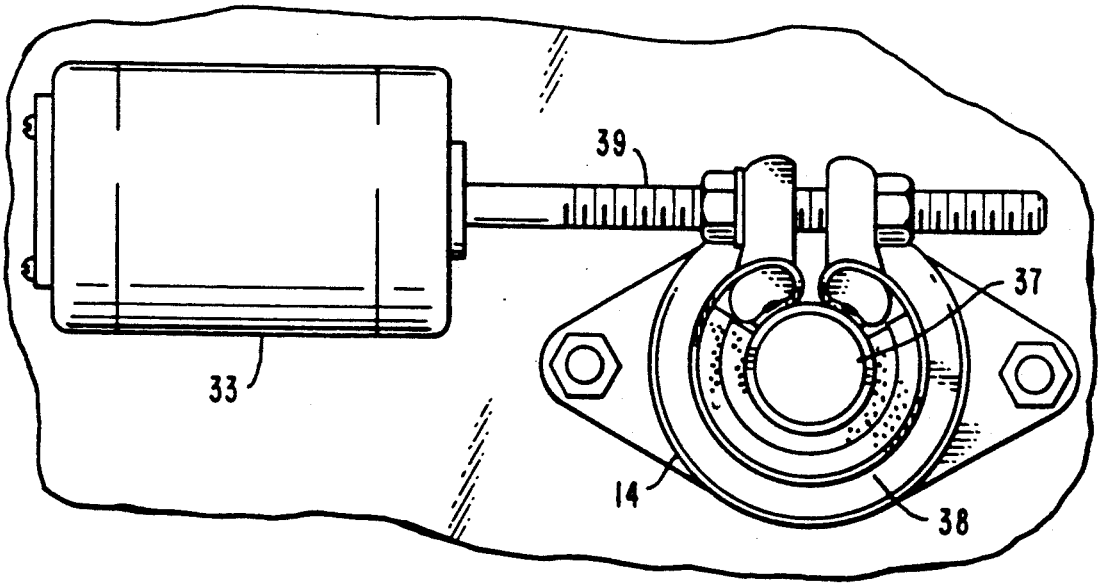
FIG. 4 is a partial bottom view of the first embodiment of the present invention.

FIG. 4 is a partial bottom view of the first embodiment, which shows more details of the tension means 14. The rod 37 which contains the pivotal axis 40A is surrounded by the casing 38. The circumference of the casing 38 is adjustable by rotating the bolt 39, thereby increasing or decreasing the rotational resistance exerted on the rod 37. The bolt 39 is connected to a motor 33 which is electrically powered for making the desired adjustments. It is preferable that each foot holder be provided with a separate motor and tension control adjustment means. This allows the user to set different tension levels for different legs.

Figure 5:
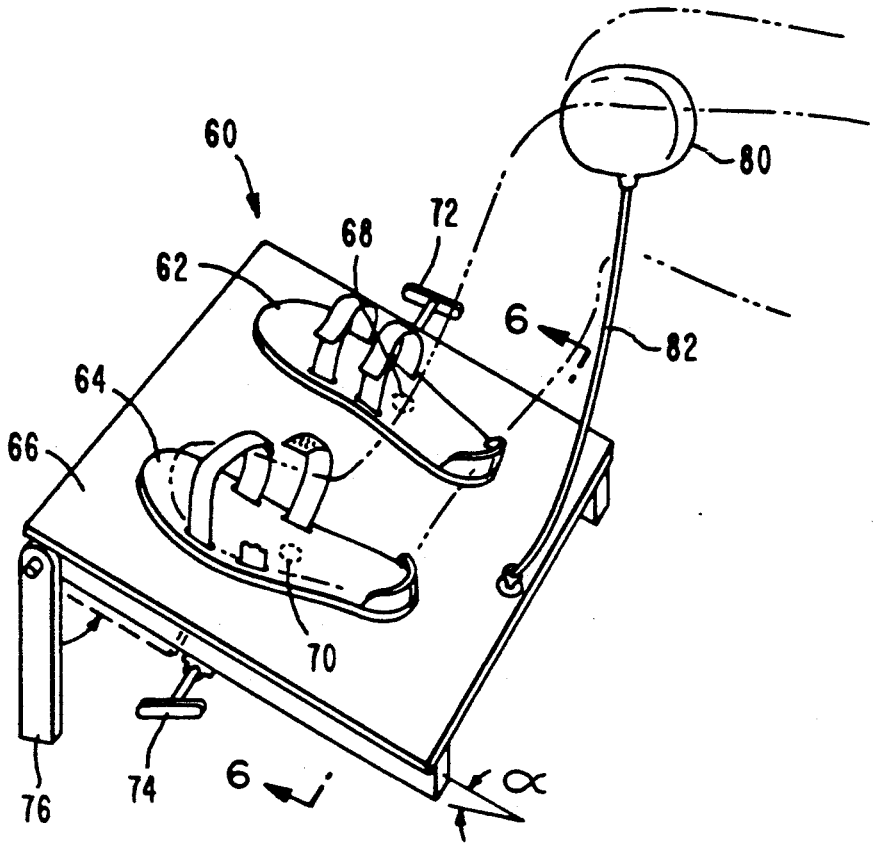
FIG. 5 is a perspective view of a second embodiment of the present invention.

FIG. 5 illustrates the second embodiment of the present invention 60, which is designed to be portable. The device 60 includes two foot holders 62 and 64 which are pivotally mounted on support board 66. Foot holder 62 is capable of pivoting around point 68, and foot holder 64 is capable of pivoting around point 70. Each foot holder is provided with a tension adjustment handle 72 and 74 respectively. The tension level for each foot holder is independently adjusted by manually turning the respective tension adjustment handle.

The support board 66 is equipped with support legs 76 which are designed to extend alternatively in two positions. The support leg 76 may be collapsed against the support board 66 when the device is being stored or transported. Alternatively, when the leg exercise device is being used, the support leg 76 is extended to be substantially perpendicular with the ground, so as to hold the support board 66 at an angle $\alpha$ relative to the ground. Preferably $\alpha$ is approximately 30 degrees.

As shown in FIG. 5, the second embodiment also includes an object 80 which is tethered to the support board 66 by a string 82. The object 80 is to be gripped by the user's legs while exercising, analogously to the upper leg post 36 of the first embodiment.

Figure 6:
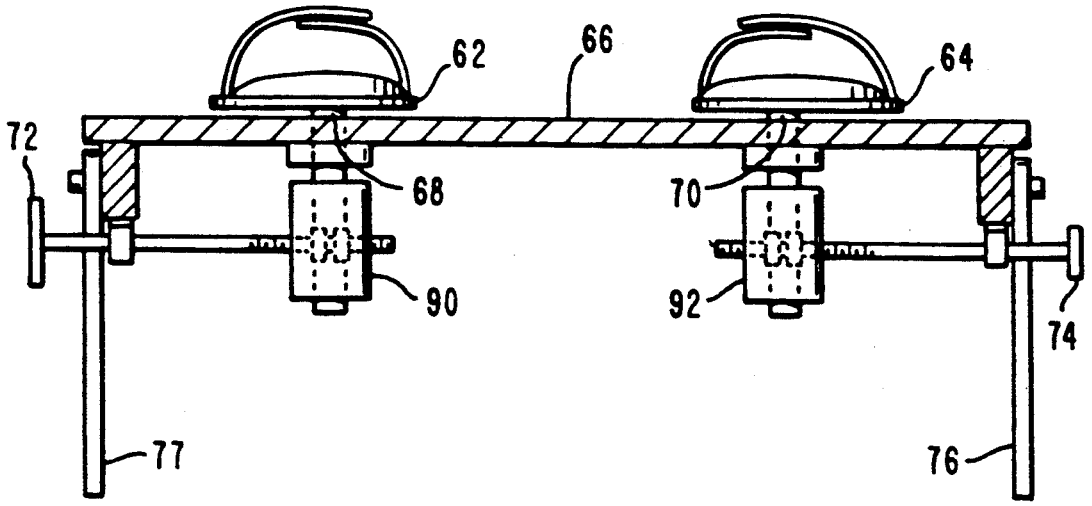
FIG. 6 is a front view of the second embodiment of the present invention.

FIG. 6 shows a front view of the second embodiment of the present invention. Resistance to pivoting of foot holders 62 and 64 around pivot points 68 and 70 respectively, is controlled by adjusting the grip of casings 90 and 92 by turning the tension adjustment handles 72 and 74.

It is intended that the claimed invention not be limited to the specific embodiments disclosed above. The claims below are intended to include variations of the preferred embodiments which provide greater flexibility or improvement in properly isolating the desired leg muscles and allowing those muscles to be advantageously exercised. For example, many other adjustable tensioning schemes could be used, including adjustments which vary the tension over a desired range while the user is exercising. Further, computer control of the tension means or other adjustments are possible to optimize the work out for particular users.

What is claimed is:

1. A leg exercising device comprising:

foot hold means for pivotally supporting a user's foot, the foot hold means being capable of pivoting around an axis which is substantially perpendicular to the foot, and near the front of the user's leg, wherein said foot hold means comprises first and second separate foot holders mounted on a planar support member, the support member being fixed at an angle of approximately 30° relative to the ground;

tension means for imparting constant resistance to pivoting of the foot hold means, said tension means comprising first and second separate adjustable braking systems for imparting constant resistance to pivoting of the first and second foot holders, so that the user can exercise both legs simultaneously; and tether means for keeping the user's knees constantly spaced and close together.

2. The device of claim 1 wherein said tether means includes a string having first and second ends, and an object having a width which is approximately equal to a desirable distance between the user's knees during exercising, the string's first end being attached to the support member and the string's second end being attached to the object, for maintaining the object in the vicinity of the support member.

3. A leg exercising device comprising:

foot hold means comprising first and second foot holders mounted on a planar support member, for pivotally supporting a user's feet, each foot holder being capable of pivoting about an axis which is substantially perpendicular to the foot, and near the front of the user's leg;

tension means for imparting constant resistance to pivoting of each foot holder; and tether means for keeping the user's knees constantly spaced and close together when said user's feet are positioned in said first and second foot holders.

* * * * *